US006466182B1

(12) United States Patent
Shigetomi et al.

(10) Patent No.: US 6,466,182 B1
(45) Date of Patent: Oct. 15, 2002

(54) VIDEO IMAGE DISPLAYING APPARATUS AND VIDEO IMAGE DISPLAYING METHOD

(75) Inventors: Tetsu Shigetomi, Kanagawa (JP); Masaomi Yamamoto, 18-34, Moegino, Aoba-ku, Yokohama-Shi, Kanagawa (JP), 227-0044; Ichiro Yasukura, Tokyo (JP)

(73) Assignees: Sony Corporation, Tokyo (JP); Masaomi Yamamoto, Kanagawa (JP)

( * ) Notice: Subject to any disclaimer, the term of this patent is extended or adjusted under 35 U.S.C. 154(b) by 0 days.

(21) Appl. No.: 09/401,974

(22) Filed: Sep. 23, 1999

(30) Foreign Application Priority Data

Sep. 25, 1998 (JP) ..... 10-270637
Dec. 7, 1998 (JP) ..... 10-347146

(51) Int. Cl.[7] ..... G09G 5/00
(52) U.S. Cl. ..... 345/1.1; 345/56; 348/149
(58) Field of Search ..... 348/143, 148, 348/149, 151, 159, 739; 345/31, 56, 1.1, 1.3, 2.2; 352/100

(56) References Cited

U.S. PATENT DOCUMENTS 5,108,171 A * 4/1992 Spaulding ..... 352/100
5,650,794 A * 7/1997 Walsh ..... 345/56
6,016,183 A * 1/2000 Yamamoto ..... 352/100

FOREIGN PATENT DOCUMENTS

| | | | | |
|---|---|---|---|---|
| EP | 0860806 | * | 8/1998 | ..... G09F/19/22 |
| GB | 2241813 | * | 9/1991 | ..... G09F/19/12 |
| JP | 07104693 | * | 4/1995 | ..... G09F/19/12 |
| WO | 98/03956 | * | 1/1998 | ..... G09F/19/12 |

* cited by examiner

*Primary Examiner*—Kent Chang
(74) *Attorney, Agent, or Firm*—Jay H. Maioli

(57) ABSTRACT

A video image displaying apparatus and video image displaying method, applicable to the supplying, by arranging a plurality of picture displaying devices for instance on the inner walls of a tunnel, of consecutive articulated images by the plurality of picture displaying devices to occupants of a train to provide consecutive articulated images using these still pictures without, for instance, causing trouble to the performance by the driver of the mobile object. Blinking of still pictures at terminal displaying apparatuses is started and ended after waiting for the passage of a prescribed part of the mobile object.

4 Claims, 7 Drawing Sheets

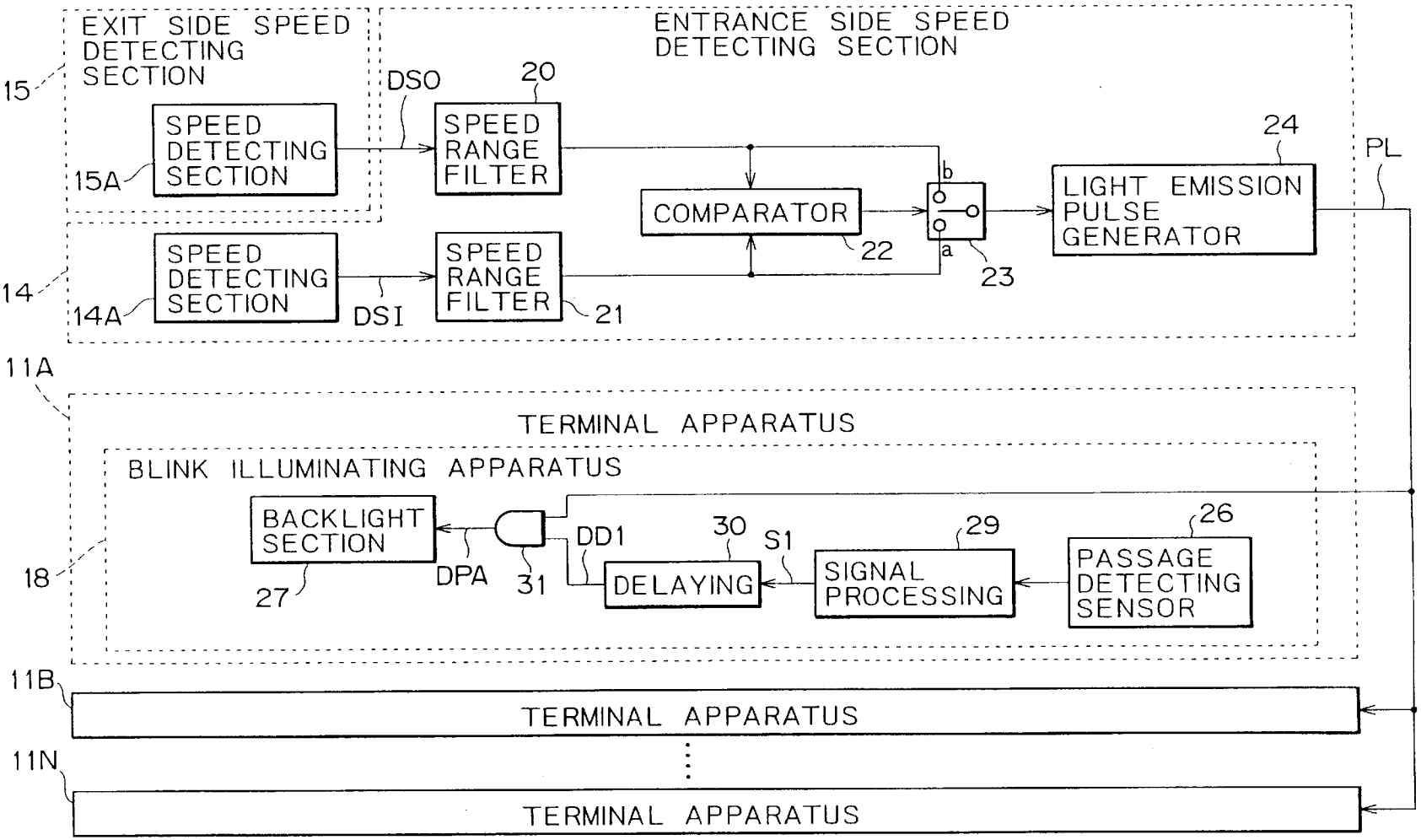
FIG. 1
ENTRANCE SIDE SPEED DETECTING SECTION
EXIT SIDE SPEED DETECTING SECTION
SPEED DETECTING SECTION
SPEED DETECTING SECTION
SPEED RANGE FILTER
SPEED RANGE FILTER
COMPARATOR
LIGHT EMISSION PULSE GENERATOR
PL
DSO
DSI
15A
14A
20
21
22
23
24
15
14
11A
TERMINAL APPARATUS
BLINK ILLUMINATING APPARATUS
BACKLIGHT SECTION
DPA
DD1
DELAYING
S1
SIGNAL PROCESSING
PASSAGE DETECTING SENSOR
27
31
30
29
26
18
TERMINAL APPARATUS
TERMINAL APPARATUS
11B
11N

FIG. 3

| TRAIN SPEED V | SPEED PER SECOND Vs | INTERVAL BETWEEN APPARATUSES C | OVERALL SYSTEM LENGTH D | TIME TAKEN TO PASS |
|---|---|---|---|---|
| 100km/h | 27.8m/S | 92.6cm | 88.3m | 10.4 SECONDS |
| 90km/h | 25.0m/S | 83.3cm | 80.0m | 11.2 SECONDS |
| 80km/h | 22.2m/S | 74.1cm | 71.7m | 12.2 SECONDS |
| 70km/h | 19.4m/S | 64.8cm | 63.3m | 13.5 SECONDS |
| 60km/h | 16.7m/S | 55.6cm | 55.0m | 15.3 SECONDS |
| 50km/h | 13.9m/S | 46.3cm | 46.7m | 17.8 SECONDS |
| 40km/h | 11.1m/S | 37.0cm | 38.3m | 21.5 SECONDS |

TRAIN LENGTH = 200m

FIG. 5

| STATE OF TRAIN IN FIG. 4 | (A) | (B) | (C) | (D) | (E) | (F) | (G) | (H) | (I) |
|---|---|---|---|---|---|---|---|---|---|
| ENTRANCE SIDE SPEED INFORMATION (km/h) DSI | 0 | 0→60 | 60 | 60 | 60 | 60→0 | 0 | 0 | 0 |
| EXIT SIDE SPEED INFORMATION (km/h) DSO | 0 | 0 | 0 | 0→60 | 60 | 60 | 60 | 60→0 | 0 |
| SPEED INFORMATION OF INPUT TO LIGHT EMISSION PULSE GENERATOR (km/h) PSO | 0 | 0→60 | 60 | 60 | 60 | 60 | 60 | 60→0 | 0 |
| COTROL BY SWITCHING CIRCUIT 23 | a | a | a | a→b | | | b | b | b→a |

VIDEO IMAGE DISPLAYING APPARATUS AND VIDEO IMAGE DISPLAYING METHOD

BACKGROUND OF THE INVENTION

1. Description of the Invention

The present invention relates to a video image displaying apparatus and video image displaying method, applicable to the supplying, by arranging a plurality of terminal displaying means for instance on the inner walls of a tunnel, of consecutive articulated images by these terminal displaying means to occupants of a vehicle. The invention, by waiting until the passage of the prescribed part of a mobile object to start and end the blinking of still pictures, provides consecutive articulated images using these still pictures without, for instance, causing trouble to the operating performance of the driver of the vehicle.

2. Description of the Related Art

According to the related art, there have been proposed, as video image displaying systems, video image displaying apparatuses for providing occupants of a vehicle passing a tunnel with consecutive articulated images from outside (the Japanese Published Unexamined Patent Application No. Hei 5-27197, Published Unexamined Patent Application No. Hei 5-40448, Published Unexamined Patent Application No. Hei 5-224617 and so on).

Such a video image displaying apparatus is enabled to provide occupants (meaning not only passengers but also the crew) of a moving vehicle with consecutive articulated images by arranging terminal picture displaying means at prescribed intervals on, for instance, the walls of a tunnel, and causing each picture displaying means to blink frames of still pictures constituting animation.

Incidentally, if animation is to be provided to passengers using such a video image displaying apparatus, the driver of the vehicle may be prevented from confirming traffic signals easily by the blinking of still pictures, and his or her duty performance may be obstructed even if no serious accident is invited.

SUMMARY OF THE INVENTION

The present invention has been attempted in view of the foregoing problem, and is intended to propose a video image displaying apparatus and a video image displaying method capable of providing consecutive articulated images by blinking still pictures without, for instance, causing trouble to the duty performance of the driver of a vehicle, which is one of mobile objects.

In order to solve this problem, according to the present invention, as applied to a video image displaying apparatus or a video image displaying method, the passage of a prescribed part of a mobile object is detected and, on the basis of this detection result, each terminal displaying means, when the prescribed part of the mobile object has passed, controls the start and/or end of blinking of still pictures.

If, at each terminal displaying means, the start and/or end of blinking of still pictures is controlled when the prescribed part of the mobile object has passed, the blinking of still pictures can be successively started from the terminal display apparatus which, for instance, the driver's seat of the vehicles has passed. In this case, it is thereby made possible to prevent the blinking from causing perception trouble to the driver and obstructing his or her performance of duty.

BRIEF DESCRIPTION OF THE DRAWINGS

FIG. 1 is a block diagram illustrating the control system for blinking in an in-tunnel system in a mode of implementation of the present invention.

FIG. 3 is a table for use in describing the arrangement among terminal apparatuses.

FIG. 5 is a table for use in describing the switching of speed detection data.

FIGS. 7A to 7D-4 show a time chart for use in the description of the configuration of FIG. 1.

DETAILED DESCRIPTION OF THE PREFERRED EMBODIMENTS

The mode of carrying out the present invention will be described in detail below, referring to drawings as appropriate.

(1) Configuration of the Mode of Implementation

Figure 2:
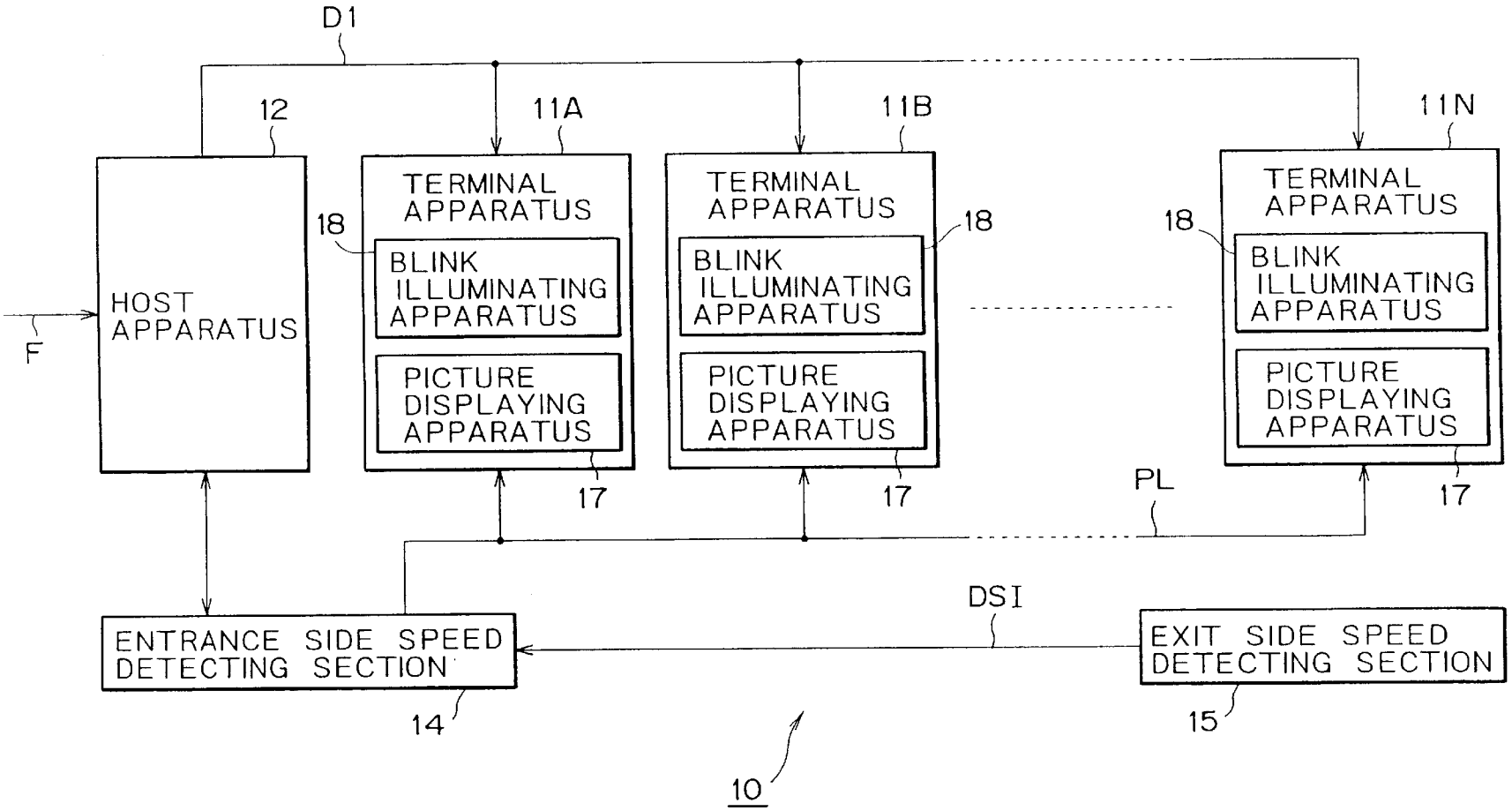
FIG. 2 is a block diagram illustrating the overall configuration of the in-tunnel system of FIG. 1.

FIG. 2 is a block diagram illustrating an in-tunnel system, which is a video image displaying system pertaining to a mode of carrying out the invention. This in-tunnel system 10 provides consecutive articulated images using still pictures to passengers of a vehicle by blinking the still pictures at prescribed intervals along the course of the vehicle. Here the in-tunnel system 10 receives the supply of an animation file F which is data-compressed in the format of MPEG (Moving Picture Experts Group), received from a superior server, and video images using this animation.

For this purposes in the in-tunnel system 10, terminal apparatuses 11A to 11N each displaying still pictures are arranged at prescribed intervals along the inner walls of the tunnel. Incidentally, in this mode of implementation, the in-tunnel system 10 is so disposed that animation be provided for about three seconds by the still pictures formed by these 90 terminal apparatuses 11A to 11N.

Further in the in-tunnel system 10, on the side from which the vehicle approaches (hereinafter called the entrance side), an entrance side speed detecting section 14 is arranged at a prescribed distance toward the entrance side of the vehicle from the terminal apparatus 11A arranged at the end of the entrance side and, conversely on the side from which the vehicle goes away (hereinafter called he exit side), an exit side speed detecting section 15 is arranged at a prescribed distance toward the exit side of the vehicle from the terminal apparatus 11N arranged at the end of the exit side.

Here, the entrance side speed detecting section 14 and the exit side speed detecting section 15 are arranged to make the distance between the entrance side speed detecting section 14 and the exit side speed detecting section 15 shorter than any train passing this tunnel so that, when a train passes, the first car passes in front of the exit side speed detecting section 15 before the final car passes in front of the entrance side speed detecting section 14. This in-tunnel system 10 is thereby enabled to continuously detect the train speed when detecting the train speed with the entrance side speed detecting section 14 and the exit side speed detecting section 15.

For the exit side speed detecting section 15, two television camera-based exit speed detecting sensors are arranged close to the railway track. The exit side speed detecting section 15 detects the passage of the train, and further the passing speed of the train, with reference to a car window, for instance, by comparatively processing the images picked up by these two television cameras with a prescribed signal processing circuit. The exit side speed detecting section 15 outputs this result of detection to the entrance side speed detecting section 14 as speed detection data DSI.

For the entrance side speed detecting section 14, similarly, two television camera-based entrance speed detecting sensors are arranged close to the railway track, and the entrance side speed detecting section 14 detects the passage of the train, and further the passing speed of the train, by comparatively processing the images picked up by these two television cameras with a prescribed signal processing circuit.

Further the entrance side speed detecting section 14, during the period in which the train is passing in front of the terminal apparatuses 11A to 11N, outputs to the terminal apparatuses 11A to 11N a light emission pulse PL, whose signal level intermittently rises in periods corresponding to the passing speed of this train as determined from this entrance side passing speed and the exit side passing speed obtained from the speed detection data DST.

Each of the terminal apparatuses 11A to 11N consists of a picture displaying apparatus 17 for displaying still pictures transmitted from a host apparatus 12, and a blink illuminating apparatus 18 for illuminating this picture displaying apparatus 17 to make pictures on the picture displaying apparatus 17 visible. The terminal apparatuses 11A to 11N are so disposed that the picture displaying apparatus 17 and the blink illuminating apparatus 18 be arranged substantially at the height of the windows of the train, so that the still pictures on the picture displaying apparatus 17 made visible by this illumination by the blink illuminating apparatus 18 can be readily watched by the passengers of the train.

Of these items, the picture displaying apparatus 17 comprises a transmissive type liquid crystal display panel having a certain level of resolution, a display circuit driving this liquid crystal display panel, and an interface for inputting picture data D1. The picture displaying apparatus 17, according to the picture data D1 in a bit map form matching the resolution level of the liquid crystal display panel, inputs from the host apparatus 12 to the terminals 11A to 11N respectively allocated still pictures.

The blink illuminating apparatus 18, which is a backlight apparatus arranged behind the liquid crystal display panel in the picture displaying apparatus 11, supplies the liquid crystal display panel with illuminating light. In this supplying of illuminating light, the blink illuminating apparatus 18, by operating in synchronism with the light emission pulse PL, intermittently supplies the illuminating light to the liquid crystal display panel in periods matching the passing speed of the vehicle, and thereby blinks still pictures on the liquid crystal display panel.

It is thereby arranged in the in-tunnel system 10 so that the passengers of the vehicle passing in front of the terminal apparatuses 11A to 11N are provided with consecutive articulated images using still pictures through the windows. Furthermore, by blinking these still pictures in periods matching the passing speed of the train, images deriving from these still pictures look still to the passengers of the train.

Incidentally, with V representing the speed per hour of the vehicle, the speed per second Vs of the vehicle is 1000×V/3600 [m/sec], and where video images are to be provided at a rate of 30 frames/second equivalent to the NTSC system, the vehicle runs at Vs/30 [m] in periods of 1/30 [m], which are the periods of this frame. Therefore, in order to provide 30 frames/second of video images, so that still pictures look still to the passengers of the vehicle when the still pictures are blinked in periods of a 1/30 second, it is necessary to arrange the terminal apparatuses 11A to 11N at intervals C of Vs/30 [m], equal to the distance the vehicle runs in a period of 1/30 second.

Further, where 90 terminal apparatuses 11A to 11N are to be arranged at such intervals C, supposing that the entrance side speed detecting section 14 and the exit side speed detecting section 15 are arranged at 2.5 [m] from the entrance side and exit side terminal apparatuses 11A and 11N toward the entrance side and exit side ends, respectively, the overall system length D, which is the distance from the entrance side speed detecting section 14 to the exit side speed detecting section 15, is represented by C×90+5 [m] and, L1 being the overall length of the vehicle, the vehicle will complete running between the entrance side speed detecting section 14 and the exit side speed detecting section 15 at (D+L1)/Vs [second].

Figures 1, 2, 3, 4, 7A, 7B, 7C, 7D:
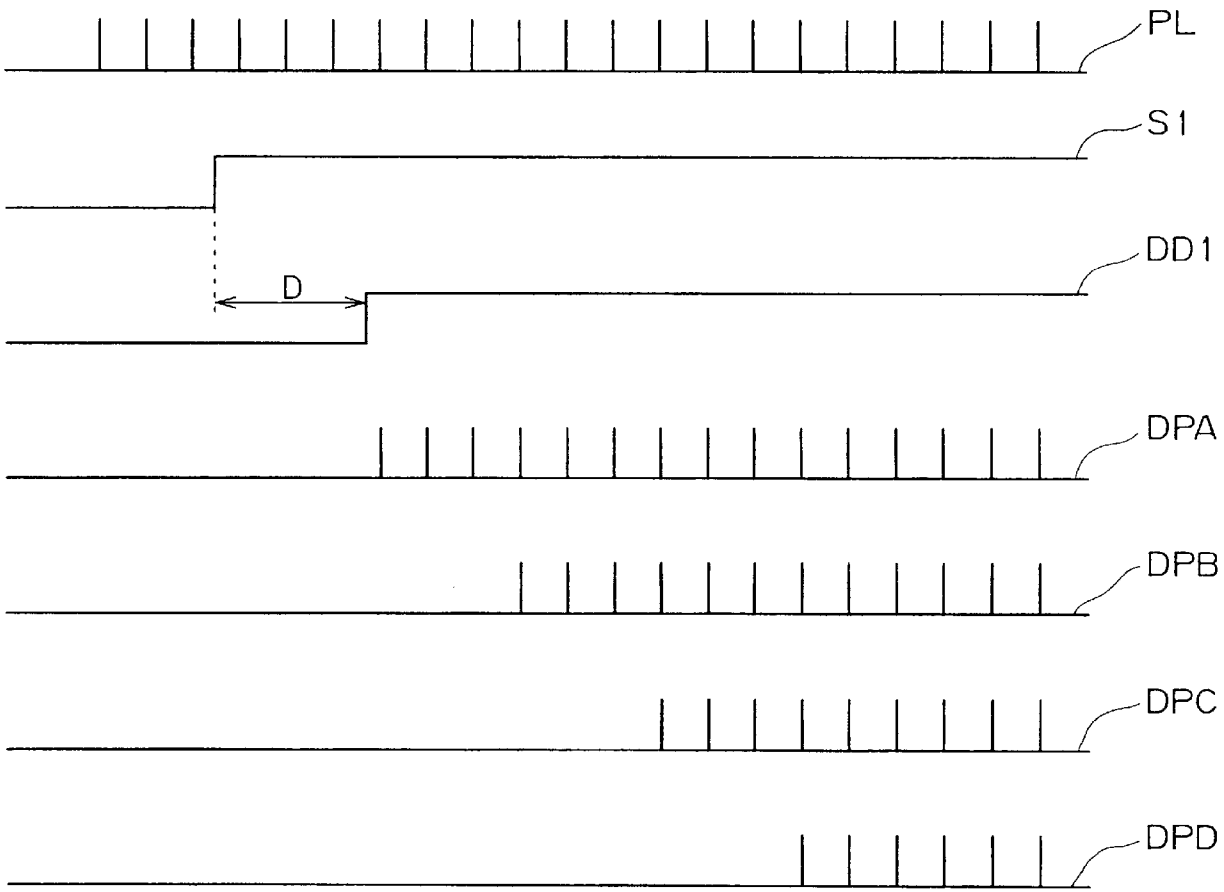

FIG. 3 is a table showing the relationship, when the vehicle length L1 is 200 [m], between these vehicle speed V, intervals C of the terminal apparatuses 11A to 11N and so forth. Thus in this mode of implementation, the terminal apparatuses 11A to 11N are arranged at intervals C which correspond to the speed V of the vehicle passing the installed position of the in-tunnel system 10.

The host apparatus 12 maintains the file F and the schedule of the animation, entered from a superior server not shown, arranged within the nearest station of these terminal apparatuses 11A to 11N. The host apparatus 12 further processes the file F of the animation according to this schedule it maintains, and transmits the picture data of each frame constituting the animation sequentially to the respectively corresponding terminal apparatuses 11A to 11N. The host apparatus 12 thereby supplies each of the terminal apparatuses 11A to 11N with the picture data D1 of the still pictures to be displayed at the terminal apparatuses 11A to 11N.

In this process, the host apparatus 12 outputs the picture data of the still pictures in bit map form matching the levels of resolution of the terminal apparatuses 11A to 11N. The host apparatus 12 thereby generates the picture data of the still pictures matching the levels of resolution of this in-tunnel system from the data of animation transmitted in a common format, and transmits the picture data of these still pictures.

Thus the host apparatus 12 temporarily holds in a hard disk apparatus the file F and schedule of animation transmitted from the server via a built-in network interface. Further the host apparatus 12 reads a prescribed file out of this hard disk apparatus in accordance with schedule management, and data-extends this file. The host apparatus 12 converts the picture data obtained by data extension to the levels of resolution in the tunnel by subjecting them to interpolating operation and thinning, and further converts them into picture data of red, blue and green corresponding to the driving of liquid crystal display panels by subjecting them to matrix operation. The host apparatus, by outputting these picture data in a sequence matching the pixel array of the liquid crystal display panels on a frame-by-frame basis, outputs picture data D1 of still pictures in bit map forms matching the levels of resolution of the liquid crystal display panels.

FIG. 1 is a block diagram illustrating the control system for a blink illuminating apparatus in this in-tunnel system together with the entrance side speed detecting section 14 and the exit side speed detecting section 15. In this FIG. 1, each of the speed detection sections 14A and 15B of the entrance side speed detecting section 14 and the exit side speed detecting section 15, respectively, consists of the aforementioned two television cameras and a signal processing circuit for detecting the passage of the train, and further the passing speed of the train, with reference to a vehicle window, for instance, by comparatively processing the images picked up by these two television cameras.

Speed range filters 20 and 21, to which speed detection data DSI and DSO respectively outputted from the speed detection sections 14A and 15B are inputted, output these speed detection data DSI and DSO to a comparator 22 and a switching circuit 23 which follow, when the passing speed of the vehicle according to these speed detection data DSI and DSO is within a certain range, by comparing them with prescribed references for comparison. The speed range filters 20 and 21 can thereby prevent erroneous actions due to noise or the like.

The comparator 22 compares the speed detection data DSI and DSO and, when the difference between the speed detection data DSI and the speed detection data DSO narrows to or below a prescribed range, instructs the switching circuit 23 to switch the contact.

The switching circuit 23, while it selects and outputs the entrance side speed detection data DSI in its initial state, selects and outputs the exit side speed detection data DSO when contact switching is instructed by the comparator 22.

Figure 4:
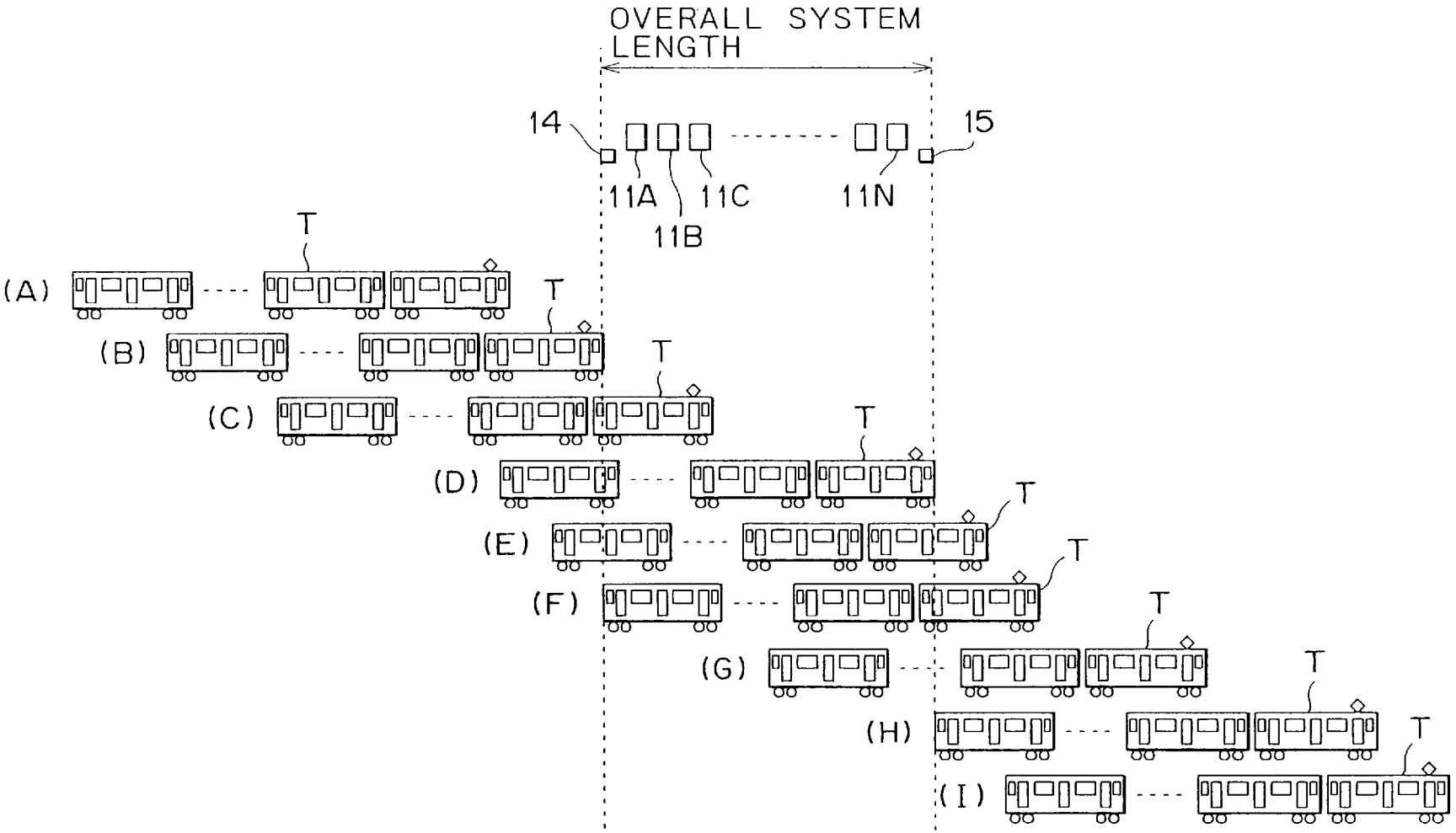
FIG. 4 is a schematic line diagram for use in describing the control of blinking.

Under these arrangements, in the switching circuit 23 in its initial state where the entrance side speed detection data DSI are selected (indicated by sign a in FIG. 1 and FIG. 5, as illustrated in FIG. 4 and FIG. 5, when a train T approaches the entrance side speed detecting section 14 (FIG. 4(A)) and its leading car passes in front of the entrance side speed detecting section 14 (FIG. 4(B) and (C) the entrance side speed detection data DSI detected by this entrance side speed detecting section 14 rose, and these speed detection data DSI that have risen are outputted to a light emission pulse generator 24 that follows.

As the train T further moves ahead and its leading car passes in front of the exit side speed detecting section 15 (FIG. 4(D)), the exit side speed detection data DSO detected by the exit side speed detecting section 15 rise, and as these exit side speed detection data DSO that have risen are stabilized to become substantially equal to the entrance side speed detection data DSI (FIG. 4(E)), the exit side speed detection data DSO are outputted to the light emission pulse generator 24 that follows in place of the entrance side speed detection data DSI.

Under this disposition, the switching circuit 23, even after the trailing car has passed the entrance side speed detecting section 14 (FIG. 4(F)), continues to notify the light emission pulse generator 24 of the speed of the train T with the exit side speed detecting section 15 until this trailing car passes the exit side speed detecting section 15 (FIGS. 4(G) and (H)). After that, the switching circuit 23, when the train T has passed in front of the exit side speed detecting section 15 (FIG. 4(I)), switches the contact to its original state, and stands by for the passage of the next train T.

The light emission pulse generator 24, on the basis of speed information obtained in this way, outputs the light emission pulse whose signal level rises in periods corresponding to the passing speed of the train.

In the blink illuminating apparatus 18, on the basis of the result of detection by a passage detecting sensor 26, a backlight section 27 is driven at a timing synchronized with this light emission pulse PL; this causes blinking of still pictures to start when a prescribed part of the train T passes each of the terminal apparatuses 11A to 11N and eventually to end the blinking.

Figure 6:
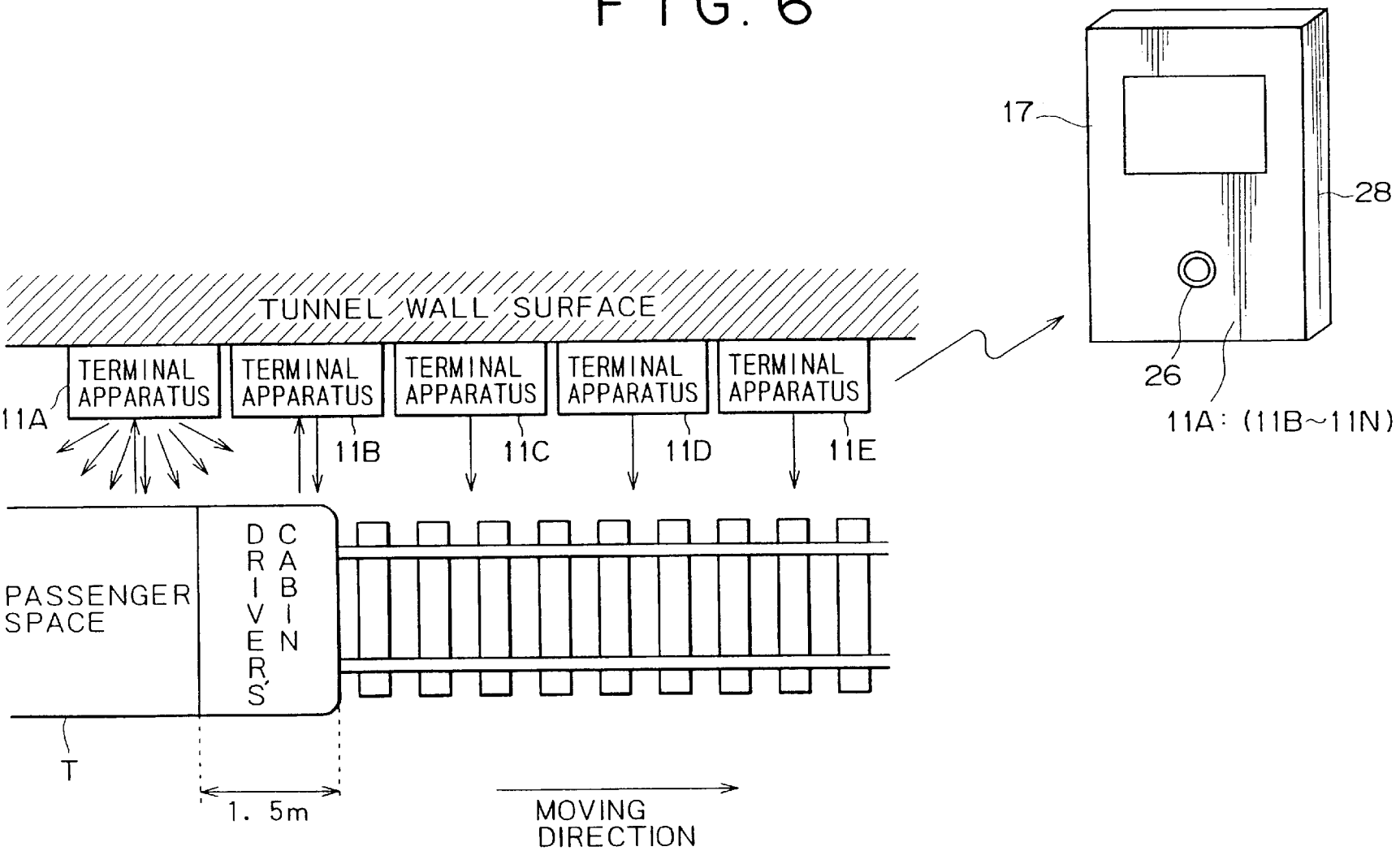
FIG. 6 is a schematic line diagram illustrating the relationship between the terminal apparatuses and the train.

As illustrated here in FIG. 6, each of the terminal apparatuses 11A to 11N is configured by housing the picture displaying apparatus 17 and the like in one of rectangularly shaped cases arranged along the wall surface of the tunnel, and the passage detecting sensor 26 is disposed facing the rail track in this case 28. This passage detecting sensor 26 is configured of a pair of a light emitting elements for irradiating a side of the passing train T with detecting light and a light receiving element for receiving the detecting light reflected and returned by the side of the train. This causes the passage detecting sensor 26 to raise the signal level of the output signals of this light receiving element during the period in which the train T is passing in front of the passage detecting sensor 26.

A signal processing circuit 29, receiving output signals of this passage detecting sensor 26, binary-encodes these output signals with reference to a prescribed reference value, and on this basis, as shown in FIGS. 7A to 7D-4, outputs a train detection signal S1 whose level rises during the period in which the train T is passing in front of the passage detecting sensor 26 (FIG. 7B)

A delaying circuit 30 delays this train detection signal S1 by a prescribed time D and outputs it (FIG. 7C). This delay time D here is set to a length of time required by the train T to run as long as the length of the driver's seat. This causes the delaying circuit 30, as illustrated in FIG. 6, to raise the signal level of output signals when the train T has run as long as the length of the driver's seat after the passage of the train T is detected from the output signal of the passage detecting sensor 26. Incidentally, here in this mode of implementation, this delay time D is set to be the time length of 3 frames corresponding to 3 periods of the light emission pulse PL which corresponds to an equivalent of L/Vs as the train T of which the driver's seat length is L=1.5 [m] is supposed to pass the position where this system is installed at an hourly speed V=60 [km/h] (the speed per second Vs=1000×V/3600 [m/sec]).

An AND circuit 31 gates the light emission pulse PL with the output signal of this delaying circuit 30, and outputs it (FIGS. 7A and 7D-1). The backlight section 27 consists of a stroboscopic tube emitting light at a timing synchronized with the output signal DPA of this AND circuit 31 and a light guide plate guiding the illuminating light outputted from this stroboscopic tube to the liquid crystal panel. Under this arrangement, at each of the terminal apparatuses 11A to 11N, with reference to the passage of the head of the train, blinking of still pictures in synchronism with the light emission pulse PL is started when the driver's seat has passed (FIGS. 7D-1 to 7D-4) and, after that, as the tail of the train passes and the train T runs by the length of its driver's seat, successively stops the blinking of still pictures. To add, in FIGS. 7A to 7D-4, pulse signals denoted by codes DPB to DPD are the output signals of the AND circuit 31 supplied to the backlight section 27 at the entrance side terminal apparatuses 11A to 11B, respectively.

(2) Operation in this Mode of Implementation

In the foregoing configuration, in the in-tunnel system 10 (FIG. 2 and FIG. 4), when the train T approaches and the first car passes in front of the entrance side speed detecting section 14 (FIG. 4(B)), the passage of the train T is detected here, and the detection of the passing speed is started. Further, as the train T successively shifts by running and its first car passes in front of the exit side speed detecting section 15 (FIG. 4(D)), the passage and the passing speed of this train T are detected by the exit side speed detecting section 15.

As the train T further runs and its final car passes in front of the entrance side speed detecting section 14 (FIG. 4(F)), the passage of this train T is detected by the entrance side speed detecting section 14, and further the detection of its passing speed is completed. After that, as this final car passes in front of the exit side speed detecting section 15 (FIG. 4(H)), the passage of this train T is detected by the exit side speed detecting section 15, too, and the detection of the passing speed is completed.

In the in-tunnel system 10, after the passage of the first car of the train is thus detected by the entrance side speed detecting section 14, until the final car passes the exit side speed detecting section 15, the light emission pulse PL whose signal level rises according to the passing speed, and as the blink illuminating apparatus 18 intermittently supplies, in synchronism with this light emission pulse PL, illuminating light to the picture displaying apparatus 17 using liquid crystal display panels to enable the terminal apparatuses 11A to 11N, arranged at prescribed intervals in the tunnel, to blink still pictures according to the moving speed of the train.

In the in-tunnel system 10, the terminals 11A to 11N thereby provide consecutive articulated images using still pictures to the passengers of the train.

The light emission pulse PL (FIG. 1 and FIG. 5), to which such blinking refers to, is generated with reference to the result of speed detection (DSI) by the entrance side speed detecting section 14, after the speed of the train T is detected by the entrance side speed detecting section 14, as the passing speed of this train T is detected by the exit side speed detecting section 15, and until the speed detected by this entrance side speed detecting section 14 and the speed detected by the exit side speed detecting section 15 become nearly equal to each other, and after that it is generated with reference to the result of speed detection (DSO) by the exit side speed detecting section 15.

This enables consecutive articulated images to be provided to all the passengers of each car after the first car has substantially passed in front of the entrance side terminal apparatus 11A until the final car passes in front of the exit side terminal apparatus 11N.

Further, when the speed detected by this entrance side speed detecting section 14 and the speed detected by the exit side speed detecting section 15 become nearly equal to each other, by generating the light emission pulse PL with reference to the result of speed detection (DSO) in the exit side speed detecting section 15, it is made possible to provide video images which do not look awkward to the passengers as this switching of the reference of generation can keep the variations in the blinking period of still pictures within a narrow enough range for practical purposes.

While the light emission pulse PL is thus supplied to each of the terminal apparatuses 11A to 11N as the reference signal for blinking, a reference signal DD1 is generated at each of the terminal apparatuses 11A to 11N in this in-tunnel system 10 with reference to a prescribed part of the train T, and the start and end of blinking are controlled with reference to this reference signal DD1.

Thus at each of the terminal apparatuses 11A to 11N, the passage of the train is detected by the passage detecting sensor 26 fitted to each of the terminal apparatuses 11A to 11N, a train detection signal S1 whose signal level rises during the period in which the train is passing in front of the terminal apparatuses 11A to 11N is generated by binary-encoding the output signal of the passage detecting sensor 26 with the signal processing circuit 29. Further, the train detection signal S1 is delayed by the length of time during which the train T runs as long as the length of the driver's seat, and the reference signal DD1 is thereby generated.

At each of the terminal apparatuses 11A to 11N, the light emission pulse PL is gated with this reference signal DD1 and supplied to the backlight section 27, and this backlight section 27 intermittently illuminates the liquid crystal panels at a timing synchronized with the light emission pulse PL, and the blinking of still pictures with reference to the reference signal DD1 is thereby started and stopped.

The terminal apparatuses 11A to 11N thus starts blinking successively, waiting for the passage of the driver's seat, which is the prescribed part of the train T, and it is thereby made possible to provide video images by the blinking of still pictures only to passengers without being perceived by the crew at the driver's seat. Consecutive articulated images using the still pictures can be thereby provided without causing any trouble to the driver's performance of duty.

Further, after the final car passes, they successively end blinking, and it is thereby made possible to provide consecutive articulated images using the still pictures without causing any trouble to, for instance, the driver on the opposite rail track. AS no wasteful repeat of blinking is made, the service life of the light source in the blinking apparatus can be correspondingly extended, and power consumption can also be saved.

(3) Advantages of this Mode of Implementation

The foregoing configuration enables a video image displaying apparatus, which is an in-tunnel system for providing passengers of a moving object with consecutive articulated still pictures by blinking still pictures, to provide consecutive articulated images using these still pictures without causing any trouble to the performance of duties by the driver of the train by waiting for a prescribed part of the train before starting or ending the blinking of the still pictures.

(4) Other Modes of Implementation

Incidentally, while the above-described mode of implementation was an instance in which the passage detecting sensor is configured of a pair of a light emitting element and a light receiving element, the present invention is not limited to this, but it can be extensively applied to other cases including one in which the passage detecting sensor consists of a sensor having a light source and a light receiving element paired with the rail track in-between and another in which the passage detecting sensor consists of a sensor using a sound wave or the like in place of light.

Also, while the above-described mode of implementation was a case in which a sensor is arranged for each of the terminal apparatuses to detect the passage of the train, the invention is not limited to this, but, for instance, a sensor may as well be arranged for only the entrance side terminal apparatus 11A to detect the passage of the train, and the start and end timings of light emission by the terminal apparatuses may be controlled with reference to the result of detection at this entrance side terminal apparatuses 11A.

In this case, the same advantage as that afforded by the above-described mode of implementation can be achieved with a simple configuration by, for example, successively delaying a train passage signal S1 detected at this terminal apparatus 11A by the length of time in which the train runs from one terminal apparatus to next and transmitting it to each of the terminal apparatuses 11B to 11N, and delaying this transmitted train passage signal S1 by the length of the driver's seat to gate the light emission pulse PL. Also, the same advantage as that provided by the above-described mode of implementation can be achieved with a simple configuration by successively delaying the reference signal DD1 by the length of time in which the train runs from one terminal apparatus to next, transmitting to each of the terminal apparatuses 11B to 11N, and directly using this transmitted DD1 to gate the light emission pulse PL.

In this case, this sensor arranged for the terminal apparatus 11A alone may also be used as the speed detecting mechanism of the entrance side speed detecting section 14.

Furthermore, while the above-described mode of implementation was a case in which the start and end of light emission are individually controlled at each terminal apparatus by gating the light emission pulse PL, the invention is not limited to this, but, for instance, the start and end of light emission may be controlled for only the entrance side terminal apparatus 11A by gating the light emission pulse PL and, for the remaining terminal apparatuses 11B to 11N, the light emission pulse PL gated at this entrance side terminal apparatus 11A successively may be delayed by the length of time in which the train runs from one terminal apparatus to next, and transmitted to the terminal apparatuses 11B to 11N.

Further, while the foregoing mode of implementation described with reference to FIG. 1 is an instance in which a passage detecting sensor 26 is arranged for each of the terminal apparatuses 11A to 11N to detect the passage of the train and the start and end of blinking by each terminal apparatus is controlled on the basis of the results of this detection, the invention is not limited to this, but the number of passage sensors may be reduced instead of arranging a passage detecting sensor 26 is arranged for each of the terminal apparatuses 11A to 11N, such sensors being arranged at prescribed intervals between the entrance side speed detecting section 14 and the exit side speed detecting section 15 and the start and end of blinking by each terminal apparatus being controlled on the basis of the results of detection by these passage detecting sensors.

In this case, with a simple configuration in which a small number of passage detection sensors relative to the number of terminal apparatuses is used, the performance of duty by the driver of the vehicle can be prevented from being troubled, even if a contingency invites an abrupt change in the speed of the vehicle, by stopping the blinking of all the terminal apparatuses if any error occurs in the control of blinking by any terminal apparatus.

Further in this case, with a simple configuration in which a small number of passage detection sensors relative to the number of terminal apparatuses is used, any abrupt change in the speed of the vehicle resulting from a contingency can be coped with by adjusting the timings of the start and end of blinking by every terminal apparatus according to lags in the individual timings of blinking instead of stopping the blinking by all the terminal apparatuses and correcting the timings of blinking according to the result of detection by each passage detecting sensor.

Further, while the above-described mode of implementation was an example in which the timing of blinking start and end is delayed only by a fixed length of time, the present invention is not limited to this, but the timing of blinking start by each terminal apparatus may be delayed by a length based on the number of light emission pulses. In this case, in the delaying circuit, a counter for counting the number of light emission pulses may be applied in place of the counter to counter the fixed length of time. In this way as well, the start and end of blinking by each terminal apparatus can be controlled without causing trouble to the performance of duty by the driver of the vehicle even if a contingency invites an abrupt change in the speed of the vehicle.

Also, while the above-described mode of implementation was a case in which blinked video images are provided to passengers of the vehicle excluding the driver, the invention is not limited to this, but it can as well be applied extensively to cases in which various video images are provided by waiting for the passage of a specific part of a vehicle to control the start and end of blinking, including, for example, one in which blinked video images are provided to the driver alone, and another in which blinked video images are provided to passengers of the green (premium-class) cars alone out of all passengers. To add, where blinked video images are provided to the driver alone, conceivably it may be a case in which necessary information for the driver is provided in video images.

Further, while the above-described mode of implementation was a case in which animation which is data-compressed by the MPEG formula, the invention is not limited to this, but it can be applied to a case in which animation data-compressed by any of various techniques is displayed and, moreover, extensively to other cases including, for example, one in which picture data of still pictures data-compressed by the JPEG (Joint Photographic Coding Experts Group) formula are inputted and displayed, and another in which picture data in a color signal form are inputted and displayed.

Also, while the above-described mode of implementation was an example in which transmissive type liquid crystal display panels are arranged at the height of train windows and still pictures are blinked thereon, the invention is not limited to this, but various other displaying techniques can be extensively applied including, for instance, blinking of still pictures which are projected on the wall surface or the like of the tunnel from liquid crystal display panels, and blinking of still pictures with an array of light emitting diodes (LEDs).

Also, while the above-described mode of implementation was an instance in which the in-tunnel systems are configured so that the distance between the terminal apparatuses at the entrance side end and the exit side end be shorter than the length of the train, the invention is not limited to this, but, conversely, the distance between the terminal apparatuses at the entrance side end and the exit side end may be longer than the length of the train.

Further, while the above-described mode of implementation was a case in which still pictures are blinked according to the train speed in such a manner that the video images of still pictures look still to the passengers of the train, the invention is not limited to this, but it can be extensively applied where, for instance, the video images of still pictures look slowly moving to the passengers.

Also, while the above-described mode of implementation was an instance in which the video images of animation are displayed by the blinking of still pictures, the invention is not limited to this, but still pictures including signs and advertisements can be displayed so as to be recognizable by the passengers and the driver by blinking the same still picture.

Further, while the above-described mode of implementation was an example in which consecutive articulated still pictures are provided to the passengers of a train by blinking still pictures in a tunnel, the invention is not limited to this, but it can be extensively applied to cases of providing consecutive articulated still pictures to the occupants of mobile objects including a case in which consecutive articulated still pictures are provided to the passengers of motor vehicles in a highway tunnel, another in which consecutive articulated still pictures are provided beside a highway or a railway at night, and still another in which consecutive articulated still pictures are provided in an amusement park.

As hitherto described, according to the present invention, regarding video image displaying apparatuses for providing video images to the occupants of a mobile object by blinking still pictures, consecutive articulated images using these still pictures can be provided without, for instance, causing trouble to the duty performance of the driver of the mobile object by waiting until the passage of a prescribed part of the mobile object to start and end the blinking of still pictures at each of the terminal display apparatuses.

What is claimed is:

1. A video image displaying apparatus for providing, by blinking still pictures at prescribed intervals along a course of a mobile object, consecutive articulated images using said still pictures to occupants of sad mobile object, the apparatus comprising:

a plurality of terminal displaying means arranged at prescribed intervals along the course of said mobile object for displaying and blinking respectively corresponding ones of said still pictures;

mobile object detecting means for detecting passage of a prescribed part and a running speed of said mobile object past said mobile object detecting means and outputting a detection result; and picture providing and blinking control means for providing said still pictures to said plurality of terminal displaying means and for controlling said prescribed blinking intervals of said still pictures in response to said detection result when the prescribed part of said mobile object passes said mobile object detecting means and in response to said running speed of said the mobile object.

2. The video image displaying apparatus as claimed in claim 1, wherein:

said mobile object is a vehicle, and said prescribed part is a seat of a driver of said vehicle.

3. A video image displaying method for providing, by blinking still pictures at prescribed intervals along a course of a mobile object, consecutive articulated images using said still pictures to occupants of said mobile object, comprising the steps of:

arranging a plurality of terminal displaying means at prescribed intervals along the course of said mobile object for displaying and blinking respectively corresponding ones of said still pictures;

detecting passage of a prescribed part and a running speed of said mobile object; and providing said still pictures to said plurality of terminal displaying means and for controlling said prescribed blinking intervals of said still pictures in response to a result of said step of detecting when the prescribed part of said mobile object passes and in response to said running speed of said mobile object.

4. The video image displaying method as claimed in claim 3, wherein said mobile object is a vehicle, and said step of detecting passage of said prescribed part includes detecting passage of a driver's seat of said vehicle.

* * * * *